US007005591B1

(12) United States Patent
Fleury

(10) Patent No.: US 7,005,591 B1
(45) Date of Patent: Feb. 28, 2006

(54) THERMOSTATIC CORD

(75) Inventor: Philip J. Fleury, St. Francois Xavier (CA)

(73) Assignee: Phillips & Temro Industries, Inc., Eden Prairie, MN (US)

( * ) Notice: Subject to any disclaimer, the term of this patent is extended or adjusted under 35 U.S.C. 154(b) by 0 days.

(21) Appl. No.: 10/931,603

(22) Filed: Sep. 1, 2004

(51) Int. Cl.
*H01R 13/70* (2006.01)

(52) U.S. Cl. ..... 200/51 R; 200/51.12

(58) Field of Classification Search ..... 200/341, 200/329, 310–314, 51 R–51.12
See application file for complete search history.

(56) References Cited

U.S. PATENT DOCUMENTS

| | | | | |
|---|---|---|---|---|
| 3,858,140 | A | 12/1974 | Hancock | |
| 4,009,482 | A * | 2/1977 | Nakata | 257/108 |
| 4,177,396 | A * | 12/1979 | Wang | 310/68 C |
| 4,538,134 | A | 8/1985 | Carey | |
| 4,570,145 | A | 2/1986 | Carey | |
| 4,699,445 | A | 10/1987 | Porta et al. | |
| 5,088,835 | A | 2/1992 | Shigezawa et al. | |
| 5,181,866 | A | 1/1993 | Jerome et al. | |
| 5,188,542 | A | 2/1993 | Ballman | |
| 5,320,563 | A | 6/1994 | Liao | |
| 5,384,559 | A | 1/1995 | Shamir | |
| 5,538,439 | A | 7/1996 | Fell et al. | |
| 5,590,010 | A | 12/1996 | Ceola et al. | |
| 5,742,464 | A | 4/1998 | Ceola et al. | |
| 5,777,868 | A | 7/1998 | Gibboney, Jr. | |
| 5,885,098 | A | 3/1999 | Witkowski | |
| 5,930,097 | A | 7/1999 | Ceola et al. | |
| 5,937,140 | A | 8/1999 | Leonard et al. | |
| 5,993,230 | A * | 11/1999 | Gauker et al. | 439/188 |
| 6,036,530 | A | 3/2000 | Edwards et al. | |
| 6,039,602 | A | 3/2000 | Witkowski et al. | |
| 6,072,152 | A | 6/2000 | Landry | |
| 6,171,118 | B1 | 1/2001 | Witkowski et al. | |
| 6,171,124 | B1 * | 1/2001 | Kojima | 439/188 |
| 6,179,654 | B1 | 1/2001 | Witkowski et al. | |
| 6,210,824 | B1 * | 4/2001 | Sullivan et al. | 429/53 |
| 6,257,923 | B1 | 7/2001 | Stone et al. | |
| 6,448,863 | B1 | 9/2002 | Ogawa et al. | |
| 6,761,570 | B1 * | 7/2004 | Patterson et al. | 439/188 |
| 6,899,556 | B1 * | 5/2005 | Nishida et al. | 439/188 |

FOREIGN PATENT DOCUMENTS

| | | | |
|---|---|---|---|
| CA | 2135948 | | 5/1995 |
| GB | 2042269 A | * | 9/1980 |
| JP | 11120880 A | * | 4/1999 |

* cited by examiner

*Primary Examiner*—Michael Friedhofer
*Assistant Examiner*—Lisa Klaus
(74) *Attorney, Agent, or Firm*—Harness, Dickey & Pierce, P.L.C.

(57) ABSTRACT

The present invention relates to an electrical thermostatic cord assembly and a method of manufacturing the same. The cord assembly includes an electrical subassembly, a protective cap, and a one-piece body. The electrical subassembly includes a thermally sensitive switch mechanism. The protective cap is disposed on at least a portion of the switch mechanism. The one-piece body is molded over the electrical subassembly such that a portion of the protective cap is exposed to allow the switch mechanism to respond to ambient temperature changes.

28 Claims, 3 Drawing Sheets

THERMOSTATIC CORD

FIELD OF THE INVENTION

The present invention relates generally to electrically powered accessories for motor vehicles and, more particularly, to a cord for such electrically powered accessories.

BACKGROUND OF THE INVENTION

Various electrically powered devices are designed for use with vehicles, including automobiles, light duty trucks, and heavy duty vehicles. These devices, including cold weather starting devices such as radiant heaters, engine block heaters, fluid heaters, battery warmers, and the like, are generally fixed to the automobile and operationally connected to an appropriate component of the vehicle engine. Further, a cord is utilized to electrically connect the specified device to a power source such as an electrical outlet. Oftentimes, however, it is desirable to electrically connect the device to the power source while simultaneously having the ability to control the flow of electricity to the device based on a change in the ambient temperature. At least one system includes a thermostat within a circuit between the power source and the device. Such systems typically include the thermostat mounted to a portion of the automobile body. A first cord is run between the power source and the thermostat. A second cord is run between the thermostat and the device. Such a system can often be cumbersome, costly and difficult to assemble within an engine compartment of a vehicle.

SUMMARY OF THE INVENTION

The present invention relates to an electrical thermostatic cord assembly comprising an electrical subassembly, a protective cap, and a one-piece body. The electrical subassembly includes a thermally sensitive switch mechanism. The protective cap is disposed on at least a portion of the switch mechanism. The one-piece body is molded over the electrical subassembly such that a portion of the protective cap is exposed to allow the switch mechanism to respond to ambient temperature changes.

A further aspect of the present invention provides a method of manufacturing a thermostatic cord assembly having an integral temperature sensitive switch mechanism. The method generally includes electrically coupling a first prong, the switch mechanism and a first wire in series. A second prong is electrically coupled to a second wire and a third prong is electrically coupled to a third wire. A body is molded around a portion of each of the prongs and a portion of the switch mechanism such that the remaining portion of each of the prongs and the switch mechanism is exposed therefrom. In this manner, the switch mechanism is enabled to respond to an ambient temperature change.

A yet further aspect of the present invention provides a method of manufacturing a thermostatic cord assembly. The method generally includes selecting a switch mechanism from a plurality of switch mechanisms having different characteristics where each switch mechanism is operable to close a circuit at a different temperature. Further, the method includes electrically connecting the switch mechanism to a first prong and molding a body portion around a portion of the first prong such that the remaining portion of the first prong is exposed therefrom to enable electrical connection to a power source.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
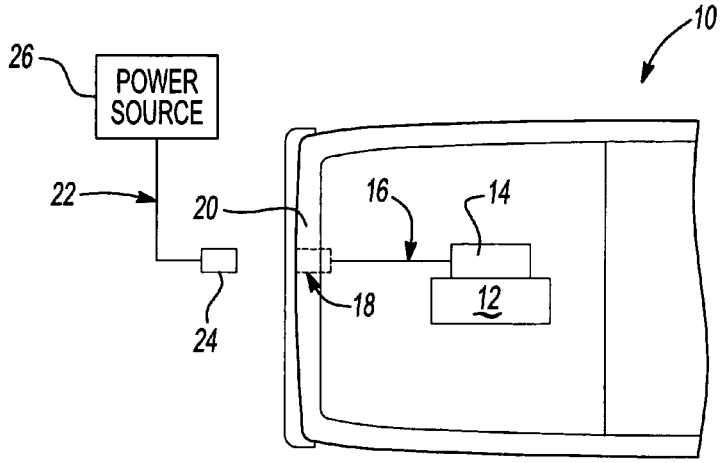
FIG. 1 is a top plan view of a portion of an automobile schematically illustrating a thermostatic cord assembly according to the present invention.

FIG. 1 depicts a vehicle 10 including an engine 12 and a powered automobile accessory 14 such as an air intake heater. A thermostatic cord set 16 is electrically connected to the accessory 14 and terminates at a plug 18. The plug 18 is mounted to a bumper or grill component 20 of the vehicle 10. An auxiliary cord 22 includes a receptacle 24 for selectively interconnecting the thermostatic cord set 16 to a power source 26 via the plug 18. The power source 26 includes an alternating current electrical outlet such as those generally mounted in walls of building structures.

Figure 2:
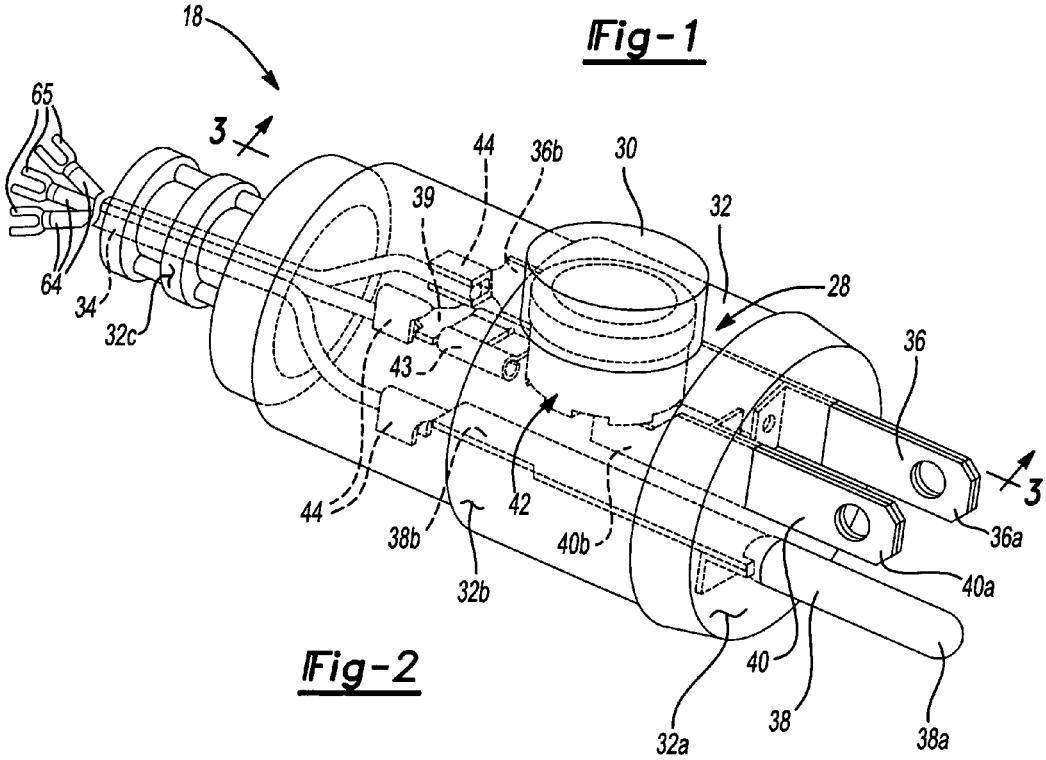
FIG. 2 is a perspective view of a first embodiment thermostatic cord assembly.

FIG. 2 depicts a first embodiment thermostatic cord set 16 including an electrical subassembly 28, a protective cap 30, a body 32, a cord 34, a neutral prong 36, a ground prong 38 and a male connector 39. Electrical subassembly 28 includes a hot prong 40, a switch mechanism 42, and a female connector 43. The neutral prong 36 includes an insertion end 36*a* with an aperture extending therethrough and an attachment end 36*b* with a pair of crimp flanges 44. The ground prong 38 includes an insertion end 38*a* and an attachment end 38*b* with a pair of crimp flanges 44. The hot prong 40 includes an insertion end 40*a* with an aperture extending therethrough and an attachment end 40*b* having an attachment flange 46 (shown in FIG. 3) with aperture 46*a* extending therethrough. The male connector 39 includes a male portion opposite a pair of crimp flanges 44.

Figure 3:
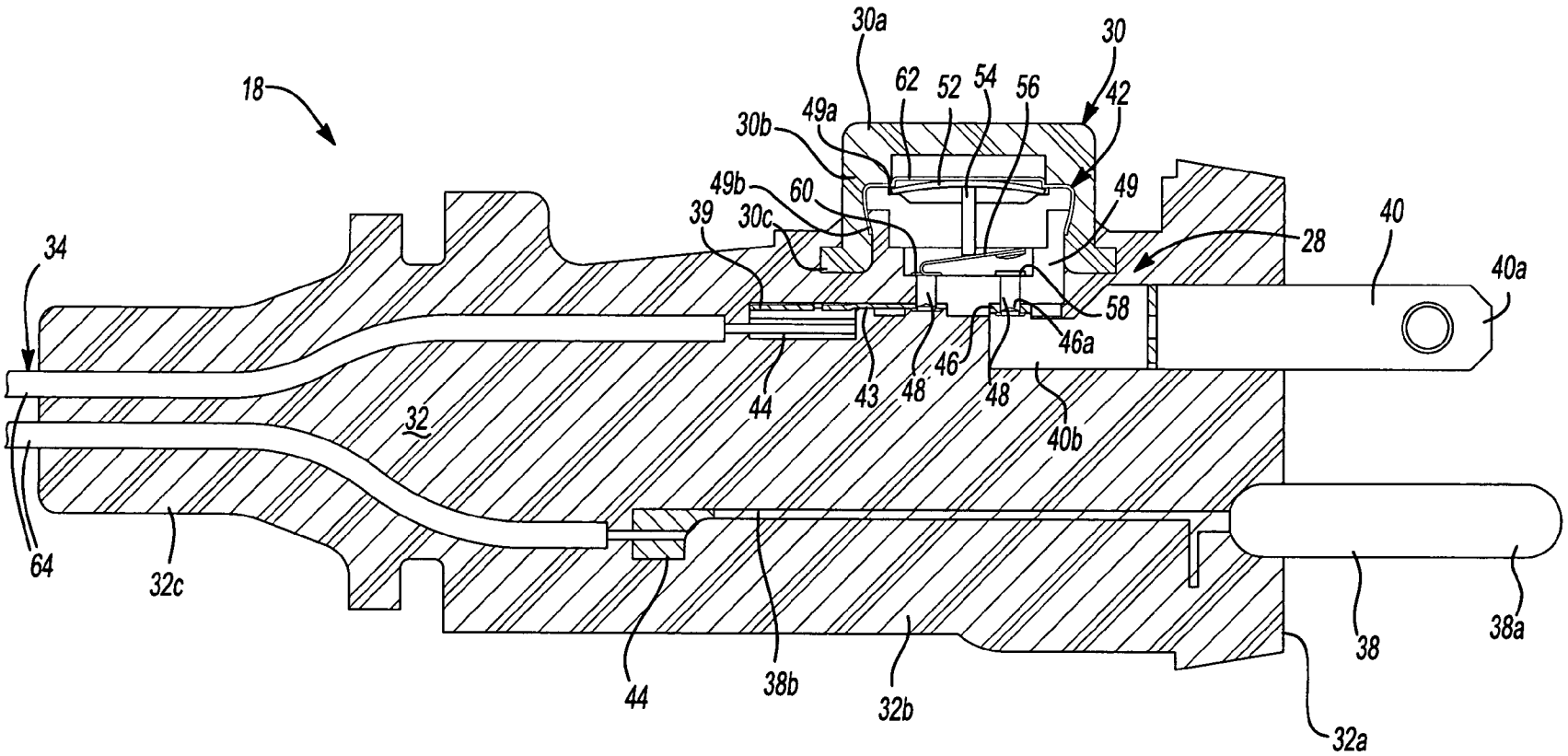
FIG. 3 is a cross-sectional view taken through line III—III of FIG. 2.

FIG. 3 depicts the switch mechanism 42 fixedly attached to the hot prong 40 via a rivet 48 through aperture 46*a* in attachment flange 46. Female connector 43 is coupled to the switch mechanism 42 with a rivet 48. Female connector 43 includes a female receptacle receiving the male portion of the male connector 39, as shown in FIG. 2. In an exemplary embodiment, the female receptacle includes a high retention, yet relatively low insertion force female disconnect receptacle such as that described in U.S. Pat. No. 5,181,866, assigned to Heyco Stamped Products, Inc., the disclosure of which is hereby incorporated by reference herein.

The switch mechanism 42 includes a housing 49, a switching member 52, a plunger 54, a lever 56, a first contact 58, a second contact 60, and a thermally conductive membrane 62. The housing 49 includes an annular ledge 49*a* and an external shoulder 49*b*. The annular ledge 49*a* supports the switching member 52. The lever 56 naturally biases open such that the plunger 54 applies an upward force on the switching member 52, as illustrated in FIG. 3. This causes switching member 52 to deform. The switching member 52 is constructed of a material having a coefficient of thermal expansion within a predetermined range. Therefore, upon the ambient temperature decreasing to be within a predetermined range of temperatures, the switching member 52 decreases in length and becomes substantially planar. This causes the plunger 54 to apply a downward force on the lever 56. A sufficient drop in ambient temperature, hence, causes the lever 56 to bridge the gap between the first contact 58 and second contact 60 and close the circuit therebetween. It should be appreciated that the switch mechanism 42 may be tuned to close the circuit within any desirable temperature range. For example, in one application, a switching member 52 having a first coefficient of thermal expansion may be utilized to close the circuit within a first predetermined temperature range. Alternatively, a switching member 52 having a second coefficient of thermal expansion different from the first coefficient of thermal expansion may be utilized to close the circuit within a second predetermined temperature range that is different than the first predetermined temperature range.

The thermally conductive membrane 62 maintains the switching member 52 in engagement with the annular ledge 49*a* within the housing 49 of the switch mechanism 42. In an exemplary embodiment, the thermally conductive membrane 62 includes a thin aluminum membrane. However, it should be appreciated that the thermally conductive membrane 62 may be constructed of any material sufficient to transfer changes in ambient temperature to the switching member 52.

The protective cap 30 includes a flat top portion 30*a*, a cylindrical wall portion 30*b*, and an external rim 30*c*. The cylindrical wall portion 30*b* includes an inner shoulder engaging the external shoulder 49*b* of the housing 49 of the switch mechanism 42. This secures the protective cap 30 thereon. As illustrated in FIG. 3, the body 32 of the plug 18 envelops the external rim 30*c* of the protective cap 30 to reinforce its maintenance on the switch mechanism 42. The flat top portion 30*a* of the protective cap 30 is envisioned to be constructed of a thin thermally conductive polymer such that it serves to protect the thermally conductive membrane 62 from physical abuse, yet enables the switching member 52 to react to ambient temperature changes. It should be appreciated that while the protective cap 30 is disclosed herein as including a flat top portion 30*a* and a cylindrical wall portion 30*b*, alternative protective caps 30 capable of serving the principles of the present invention are intended to be within the scope of the present invention. In an exemplary embodiment, the entire protective cap 30 is constructed via an injection molding process such that the flat top portion 30*a* is integral with the cylindrical wall portion 30*b*.

The body 32 is also constructed of a polymer via an injection molding process. The body 32 includes an insertion face 32*a*, a central portion 32*b*, and a cord portion 32*c*. The body 32 includes a single structure enveloping portions of appropriate components of the plug 18. Specifically, the insertion ends 36*a*, 38*a*, 40*a* of the neutral prong 36, ground prong 38, and hot prong 40 extend from the insertion face 32*a* of the body 32. Furthermore, the flat top portion 30*a* of the protective cap 30 is exposed from the central portion 32*b* of the body 32. This ensures the least amount of thermal insulation in the region of the switching member 52 of the switch mechanism 42. Lastly, the cord 34 extends from the cord portion 32*c* of the body 32. The cord 34 includes three wires 64 (as shown in FIG. 2). In an exemplary embodiment the three wires 64 share a wire jacket. The three wires 64 are each crimped between the crimp flanges 44 of one of the neutral prong 36, ground prong 38, and male connector 39. The cord 34 therefore is operable to transmit electricity to the automobile accessory 14, as described above.

Figure 4:
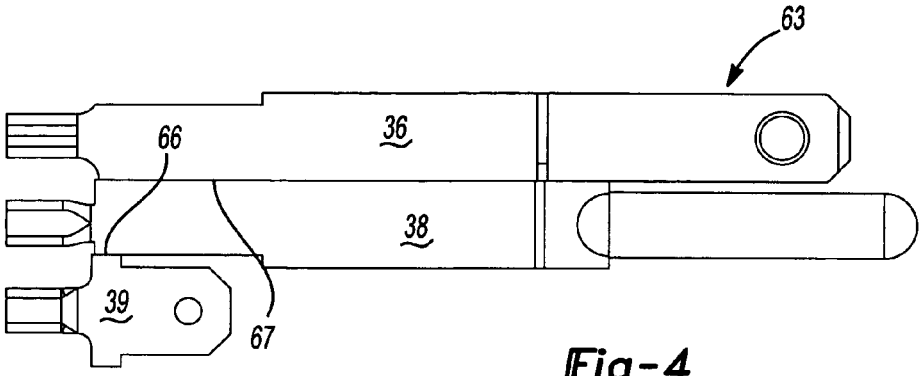
FIG. 4 is a front plan view of the components of an electrical subassembly of the thermostatic cord assembly shown in FIGS. 2 and 3.

During manufacture, a large spool of connector units 63 is unwound. As shown in FIG. 4, each connector unit 63 includes a neutral prong 36, a ground prong 38, and a male connector 39. A first seam 66 attaches a side of the male connector 39 to one side of the ground prong 38. A second seam 67 attaches an opposite side of the ground prong 38 to a side of the neutral prong 36. This enables the neutral prong 36, ground prong 38, and male connector 39 to be detached from the spool as a connector unit 63. It should be appreciated that an exemplary spool includes a multiplicity of connector units 63 attached together as a continuous belt.

Next, a large spool of the cord 34 is unwound to a desired length and cut. An end of the cut cord 34 is stripped to expose the three separate wires 64. The three wires 64 are inserted into the crimp flanges 44 on the male connector 39, neutral prong 36, and ground prong 38. After insertion, a force is applied to crimp the crimp flanges 44 together, thereby securing the wires 64 thereto. In an exemplary embodiment, the three exposed ends of the wires 64 are simultaneously inserted into the crimp flanges 44 and secured therein. This helps reduce the processing time associated with manipulating each crimp flange 44 separately. The male connector 39 is then detached from the ground prong 38 at seam 66. The ground prong 38 is then detached from the neutral prong 36 at seam 67. Detachment is achieved by simply breaking the seams 66, 67 by hand or by machine.

Next, with reference to FIG. 3, the hot prong 40 and female connector 43 are attached to the switch mechanism 42 to define electrical subassembly 28. This includes providing rivets 48 through the hot prong 40, female connector 43 and into engagement with the first 58 and second contacts 60. This engagement is achieved using a typical riveting tool or machine as is commonly known in the art. The male portion of the male connector 39 is then inserted into the female portion of the female connector 43. The protective cap 30 is then pressed over and secured on the thermally conductive membrane 62 of the switch mechanism 42.

The electrical subassembly 28 coupled to male connector 39, as well as the neutral prong 36, ground prong 38 and a portion of cord 34 are all placed within a mold cavity. The mold cavity defines the external geometry of the body 32 of the plug 18. It is important to note that the insertion ends of the neutral prong 36, ground prong 38, and hot prong 40, as well as the flat top portion 30*a* of the protective cap 30, extend out of the mold cavity. With the aforementioned components in place, a semi-liquid polymer is injected into the mold cavity to form the body 32 of the plug 18. Once the semi-liquid polymer cures, the plug 18 is removed from the mold cavity. Lastly, electrical connectors 65 are attached to the opposite end of the cord 34 (as shown in FIG. 2). The electrical connectors 65 enable the cord 34 to be attached to the automobile accessory 14 described above.

It should be appreciated that the hot prong 40, switch mechanism 42, female connector 43 and male connector 39 are connected in series to selectively provide power from power source 26 to accessory 14. Furthermore, it should be appreciated that these components provide a mechanical robustness that aids in the manufacturing process described above. Because these components are rigidly connected via the rivets 48, the electrical subassembly 28 is more capable of supporting itself within the mold cavity prior to molding the body 32.

Figure 5:
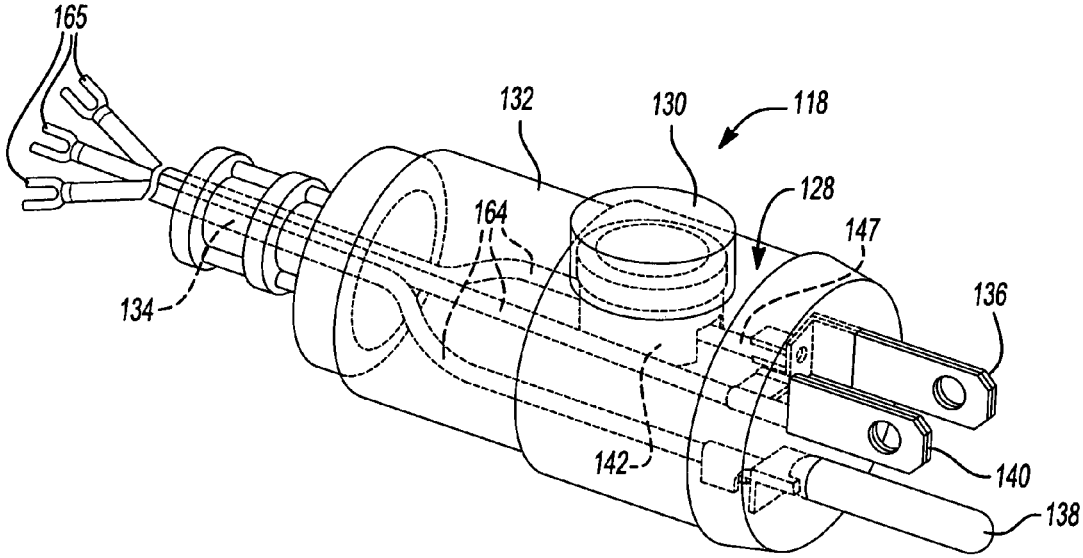
FIG. 5 is a perspective view of a second embodiment thermostatic cord assembly.

FIG. 5 depicts an alternative embodiment of a plug 118 in accordance with the principles of the present invention. The plug 118 of the second embodiment is substantially similar to the plug 18 of the first embodiment. The plug 118 includes an electrical subassembly 128, a protective cap 130, a body 132, a cord 134, a neutral prong 136, a ground prong 138 and a hot prong 140. The electrical subassembly 128 includes a switch mechanism 142 and a jumper wire 147. Similar to that described above with reference to the first embodiment, the switch mechanism 142 is electrically connected in series with the hot prong 140. However, the hot prong 140 does not extend to and rigidly attach with a first contact (not shown) of the switch mechanism 142. Rather, the jumper wire 147 provides the electrical connection between the hot prong 140 and the switch mechanism 142. Furthermore, the switch mechanism 142 does not include a female connector 43 attached to the second contact (not shown). Therefore, one of wires 164 of the cord 134 directly connects to a second contact (not shown) on the switch mechanism 142. It should be appreciated that the switch mechanism 142 is otherwise identical to the switch mechanism 42 described above in accordance with the first embodiment.

The method of manufacturing the plug 118 is substantially similar to manufacturing the plug 18 described above, with an exception to the assembly of the electrical subassembly 128 and connection of male connector 39 to the electrical subassembly. Specifically, the switch mechanism 142 is connected with the hot prong 140 via the jumper wire 147, as opposed to the rigid connection established with the rivet 48. It is envisioned that one end of the jumper wire 147 is attached to the hot prong 140 and the opposite end of jumper wire 147 is coupled to the switch mechanism 142 using solder or a similar material. Furthermore, one of the wires 164 of the cord 134 is directly connected to an opposite side of the switch mechanism 142, as opposed to the rigid connection established by the female connector 43 and male connector 39 of the first embodiment. This connection is also envisioned to be achieved via the use of solder or some similar material.

The remainder of the manufacturing process is generally identical to that disclosed with reference to the first embodiment. The neutral prong 136, ground prong 138, hot prong 140, jumper wire 147, electrical subassembly 128 and a portion of the cord 134 are all positioned within a mold cavity. A semi-liquid polymer is then injected into the mold cavity to form the body 132. Once the polymer cures, the plug 118 is removed from the cavity and electrical connectors 165 may be attached to the opposite end of the cord 134 in preparation for use with the vehicle accessory 14.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. An electrical thermostatic cord assembly for use with an automobile accessory mounted to an automobile body, the cord assembly comprising:

an electrical subassembly including a thermally sensitive switch mechanism connected therewith;

a protective cap disposed on at least a portion of said switch mechanism; and a one-piece body molded over said electrical subassembly such that a portion of said protective cap is exposed therefrom to allow said switch mechanism to respond to ambient temperature changes.

2. The assembly of claim 1, wherein said electrical subassembly includes a first prong and a first connector coupled to said switch mechanism in series.

3. The assembly of claim 2 further including a second prong and a third prong, wherein said first prong, said second prong and said third prong are electrically isolated from one another.

4. The assembly of claim 3 further including a second connector, wherein one of said first connector and said second connector includes a male end disposed within a female end of the other of said first connector and said second connector.

5. The assembly of claim 3, further comprising a predetermined length of wire attached to and extending from each of said second prong, said third prong, and said second connector.

6. The assembly of claim 1, wherein said switch mechanism includes a switching component having a predetermined coefficient of thermal expansion.

7. A method of manufacturing an electrical thermostatic cord assembly having an integral temperature sensitive switch mechanism, comprising:

electrically coupling a first prong, the switch mechanism and a first wire in series;

electrically coupling a second prong to a second wire;

electrically coupling a third prong to a third wire; and molding a body around a portion of each of said prongs and a portion of said switch mechanism such that a remaining portion of each of said prongs and said switch mechanism is exposed therefrom to enable the switch mechanism to respond to an ambient temperature change.

8. The method of claim 7 further including mounting a first connector to said switch mechanism and attaching a second connector to said first wire.

9. The method of claim 8 further including coupling said second connector to said first connector and molding said body around both of said first and second connectors.

10. The method of claim 9 further including inserting a male end of one of said first connector and said second connector into a female end of the other of said first connector and said second connector.

11. The method of claim 8 further including substantially simultaneously attaching said third wire to said third prong, attaching said second wire to said second prong and attaching said first wire to said second connector.

12. The method of claim 7 further including rigidly mounting said first prong to said switch mechanism prior to molding said body.

13. The method of claim 7 further including coupling a jumper wire between said first prong and said switch mechanism.

14. The method of claim 7 further comprising placing said first, second and third prongs into a mold cavity prior to molding said body such that portions of said prongs extend from said mold cavity.

15. A method of manufacturing a thermostatic cord assembly comprising:

selecting a switch mechanism from a plurality of switch mechanisms having different characteristics where each switch mechanism is operable to close a circuit at a different temperature;

electrically connecting said switch mechanism to a first prong; and molding a body around a portion of said first prong such that a remaining portion of said first prong is exposed therefrom to enable electrical connection to a power source.

16. The method of claim 15 further including molding said body around a portion of said switch mechanism wherein a remaining portion of said switch mechanism is exposed therefrom to enable the switch mechanism to respond to an ambient temperature change.

17. The method of claim 16 further including placing a protective cap over at least a portion of the switch.

18. The method of claim 17 further including molding said body around a portion of a second prong and a third prong.

19. The method of claim 18 further including molding said body around a portion of said protective cap where a remaining portion is exposed to ambient air.

20. The method of claim 19 further including inserting a male end of one of a first connector and a second connector into a female end of the other of said first connector and said second connector and electrically coupling said first and second connectors in series.

21. The method of claim 20 further including placing said first connector, said second connector, said first prong, said second prong and said third prong into a mold cavity prior to molding said body such that said first and second connectors are positioned to be encapsulated by said body and where portions of said prongs extend from said mold cavity.

22. An electrical thermostatic cord assembly for use with an automobile accessory mounted to an automobile body, the cord assembly comprising:

an electrical cord adapted to electrically interconnect the automobile accessory with an external power source, the electrical cord having a plug at one end including an electrical subassembly, said electrically subassembly including a thermally sensitive switch mechanism connected therewith;

a protective cap disposed on at least a portion of said switch mechanism; and a one-piece body molded over said electrical subassembly such that a portion of said protective cap is exposed therefrom to allow said switch mechanism to respond to ambient temperature changes.

23. The assembly of claim 22 wherein said plug is adapted to be mounted to the automobile body.

24. The assembly of claim 22 wherein said electrical subassembly includes electrical contacts at least partially embedded within said one-piece body.

25. The assembly of claim 24 wherein said electrical contacts include male prongs protruding from said one-piece body.

26. An electrical thermostatic cord assembly for use with an automobile accessory mounted to an automobile body, the cord assembly comprising:

a cord having a first end electrically connected to the automobile accessory, a second end having a plug with male electrical contacts extending from a body of said plug, and a thermally sensitive switch mechanism electrically connected with said male electrical contacts; and a protective cap covering at least a portion of said thermally sensitive switch mechanism, said body partially encompassing said thermally sensitive switch mechanism and said protective cap, a portion of said protective cap being exposed to ambient air, said thermally sensitive switch mechanism being operable to respond to changes in ambient temperature.

27. The assembly of claim 26 wherein said protective cap protrudes from said body.

28. The assembly of claim 26 wherein said plug is adapted to be mounted to the automobile body.

* * * * *

UNITED STATES PATENT AND TRADEMARK OFFICE

CERTIFICATE OF CORRECTION

PATENT NO. : 7,005,591 B1
APPLICATION NO. : 10/931603
DATED : February 28, 2006
INVENTOR(S) : Philip J. Fleury It is certified that error appears in the above-identified patent and that said Letters Patent is hereby corrected as shown below:

Title Page, Item (56) References Cited, under FOREIGN PATENT DOCUMENTS, Line 1: "5/1995" should be -- 5/1996 --

Signed and Sealed this

Twenty-second Day of August, 2006

JON W. DUDAS
*Director of the United States Patent and Trademark Office*